US005428863A

United States Patent [19]

Tanasescu et al.

[11] Patent Number: 5,428,863

[45] Date of Patent: Jul. 4, 1995

[54] WATER SUCTION MECHANISM

[75] Inventors: Ovidiu Tanasescu, Ateljévägen 10, S-172 41 Sundbyberg; Razvan Turcea, Enskede; Mihai Teleki, Kista, all of Sweden

[73] Assignee: Ovidiu Tanasescu, Sweden

[21] Appl. No.: 117,138

[22] PCT Filed: Mar. 20, 1992

[86] PCT No.: PCT/SE92/00174

§ 371 Date: Sep. 16, 1993

§ 102(e) Date: Sep. 16, 1993

[87] PCT Pub. No.: WO92/16139

PCT Pub. Date: Oct. 1, 1992

[30] Foreign Application Priority Data

Mar. 21, 1991 [SE] Sweden ..... 9100858

[51] Int. Cl.[6] ..... A47L 11/293

[52] U.S. Cl. ..... 15/322; 15/320; 15/364; 15/385

[58] Field of Search ..... 15/320, 322, 321, 384, 15/385

[56] References Cited

U.S. PATENT DOCUMENTS

| | | | |
|---|---|---|---|
| Re. 24,583 | 12/1958 | Brown . | |
| 1,821,715 | 9/1931 | Kuchinsky | 15/322 |
| 2,168,692 | 8/1939 | Vidal | 15/320 |
| 2,774,089 | 12/1956 | Brown . | |
| 3,189,930 | 6/1965 | Tuthill, Jr. . | |
| 3,619,848 | 11/1971 | Salzmann | 15/320 |
| 4,000,538 | 1/1977 | Tissier . | |
| 5,163,203 | 11/1992 | Tanasescu et al. | 15/320 X |

FOREIGN PATENT DOCUMENTS

| | | |
|---|---|---|
| 915854 | 7/1954 | Denmark . |
| 461700 | 3/1990 | Sweden . |
| WO9003757 | 4/1990 | WIPO . |

*Primary Examiner*—Christopher K. Moore

*Attorney, Agent, or Firm*—Banner, Birch, McKie & Beckett

[57] ABSTRACT

A water suction apparatus for scrubbing machines having a non-rotatable frame (11), a rotatable scrubbing-brush (1 *a*) and a rotatably driven holder (1) therefore. The holder has a ring (7) around its periphery, the ring being provided with nozzles (2) which have lower ends in gliding contact with or positioned immediately above the floor and which suck dirty scrub water therefrom, the ring also being provided with lips (5) which are located between the nozzles and have lower ends in gliding contact with the floor and which transmit dirty scrub water to the nozzles when the ring rotates. The frame (11) has a ring (4) connected thereto which sealingly cooperates with the rotatable ring (7) on the holder (1) and which is provided with at least one nozzle (6) which is connected to a conduit (12) transmitting dirty scrub water from the nozzles (2) on the rotatable ring to a water separator or the like.

6 Claims, 1 Drawing Sheet

WATER SUCTION MECHANISM

TECHNICAL FIELD

The present invention refers to a water suction apparatus for scrubbing, shampooing and polishing machines as described in the introductory portion of claim 1.

DESCRIPTION OF PRIOR ART

Today, no efficient water suction apparatuses for such machines exist on the market. The known scrubbing machines have their scrubbing-brushes located separately from the suction nozzle which is located behind the scrubbing-brushes. With such an arrangement the floor will not be completely dry and dirty water will remain on the floor after cleaning.

The first efficient system for suction of scrub water is described in Swedish laid-open print No. 461.700 and the corresponding WO 90/03757. However, this system is not sufficiently simple.

DESCRIPTION OF THE INVENTION

It is an object of the present invention to simplify and improve known water suction apparatuses for scrubbing, shampooing and polishing machines. This object is achieved by the invention having the features described in the characterizing portion of the claims.

DESCRIPTION OF PREFERRED EMBODIMENT

Figure 2:
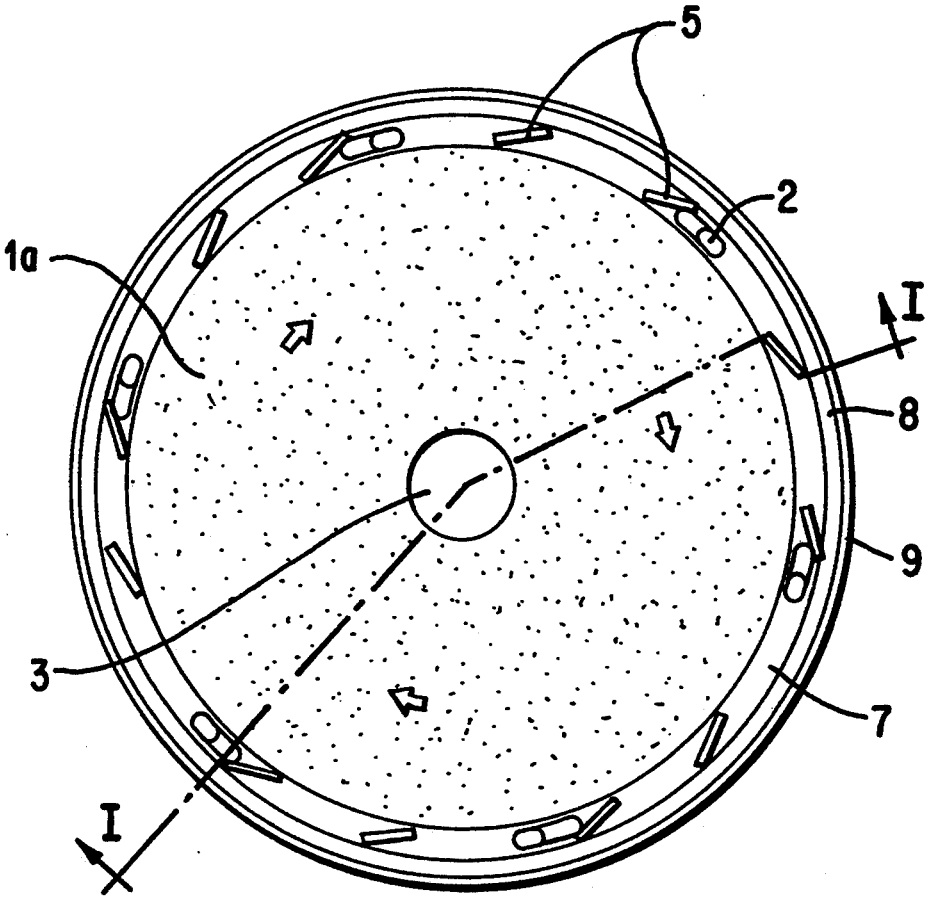
FIG. 2 is a view from below of the water suction apparatus in FIG. 1.

Numeral 1 designates a scrubbing-brush holder for a scrubbing-brush 1*a*. The scrubbing-brush 1*a* rotates in the same direction and at the same speed as the brush holder 1. Around the circumference of the brush holder 1 are attached a number of nozzles 2 which rotate together with the brush holder when the apparatus is in use. All the nozzles 2 are attached on and pass through a ring 7 which is formed on the circumference of the brush holder 1 on the upper side thereof. The nozzles 2 which are formed as pipes, tubes or hoses consist of durable elastic or flexible material, such as plastics or rubber. The nozzles 2 are obliquely oriented in relation to the floor, which can be seen in FIG. 2, and the lower ends thereof are positioned just above or in contact with the floor. The lower openings of the nozzle are flush with the floor and glide thereon when the machine is in use.

On the underside of the ring 7 there are attached a number of flexible lips or flaps 5 which are in contact with the floor. In order to automatically regulate the pressure of the lips towards the floor springs 10 can be mounted at the locations where the lips are connected to the ring 7. The nozzles 2 and the lips 5 are alternately located so that all dirty water collected and moved by the lips will be sucked in through the nozzles.

Since the ring 7 rotates at the same speed and in the same direction as the scrubbing-brush 1*a* and its holder 1 the nozzles 2 and the lips 5 as well will rotate at this speed and in this direction. The rotation is achieved by a motor (not shown) coupled to the holder 1.

Figure 1:
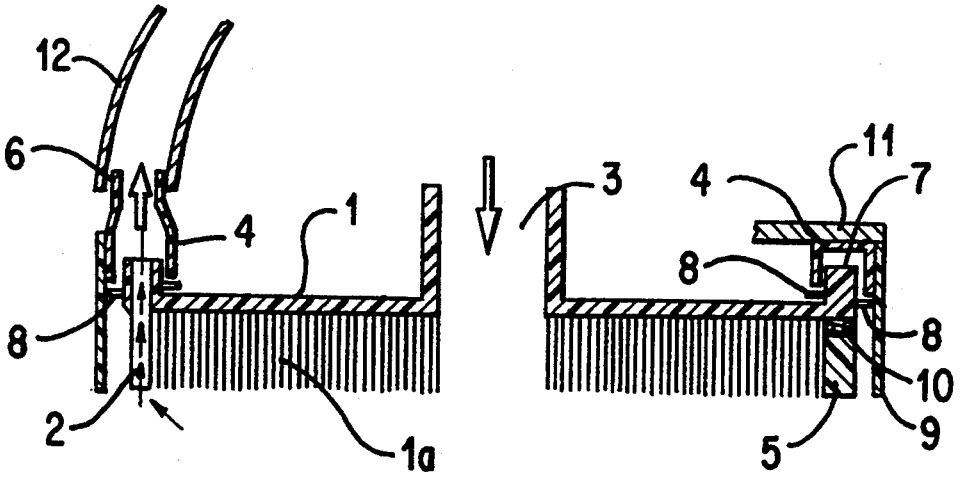
FIG. 1 is a vertical section along line I—I in FIG. 2 of a water suction apparatus according to the invention for scrubbing machines.

A U-shaped second ring 4 is fixedly mounted on the non-rotatable frame 11 of the machine and is arranged above and partly encloses the first ring 7. The second ring 4 does not rotate and has one or more openings 6 around its periphery. The second ring 4 is mounted very close to the first ring 7 as is shown to the right in FIG. 1. The openings 6 are connected to a hose 12.

Clean water containing detergent is fed through a hose (not shown) to a tube 3 in the centre of the brush holder 1. This water is transmitted over the floor by the brush 1*a* when the apparatus is in use. The lips 5 will move dirty water to the nozzles 2 which divert the dirty water to the ring 4. Via the openings 6 and the hose 12 connected thereto the dirty scrub water will be fed by suction to a water separator where the water is collected.

On the radially inner and outer surfaces of the ring 7 are fastened annular sealing lips 8. These lips are in contact with the downwardly projecting legs of the U-shaped ring 4. When the scrubbing machine is in operation the lips 8 provide a good glide seal between the rings 4 and 7, the sealing effect being increased by the suction effect in the ring 4.

A non-rotating safety ring 9 is fastened to the periphery of the ring 4. The lower edge of the ring 9 is in close contact with the floor. When the apparatus according to the invention is in operation clean water containing detergent is fed through the tube 3 and is spread out regularly by the brush 1*a*. The ring 9 prevents water from leaving the area within it. In some applications the ring 9 is not necessary because the lips 5 will prevent water from passing them regularly outwards. Because the apparatus is very compact it is possible to clean areas under tables, beds, shelves or other areas which are difficult to reach. The apparatus can also be used in larger scrubbing machines which will make them more compact than scrubbing machines used today. Due to the design of the apparatus described above the floor is practically dry after cleaning and dirty scrub water will not remain on the floor.

Even if only one embodiment of the invention has been described above and shown on the drawings it should be understood that the invention is not limited to this embodiment but only to that which is stated in the claims.

We claim:

1. A water suction apparatus for scrubbing machines and the like having a non-rotatable frame, a rotatable scrubbing-brush and a rotatably driven holder therefor, characterized in that the holder has a ring around its periphery, the ring being provided with nozzles which have lower ends in gliding contact with the floor and which suck dirty scrub water therefrom, the ring also being provided with lips which are located between the nozzles and have lower ends in gliding contact with the floor and which transmit dirty scrub water to the nozzles when the ring rotates, that the frame has a ring connected thereto which sealingly cooperates with the rotatable ring on the holder and which is provided with at least one nozzle which is connected to a conduit transmitting dirty scrub water from the nozzles on the rotatable ring to a water separator or the like.

2. An apparatus according to claim 1, characterized in that the sealing cooperation between the two rings is accomplished by flexible annular lips on at least one of the rings.

3. An apparatus according to claim 1, characterized in that the nozzles on the rotatable ring include flexible hoses.

4. An apparatus according to claim 3, characterized in that the hoses are inclined in the rotational direction of the rotatable ring.

5. An apparatus according to claim 1, characterized by a non-rotatable, protective, ring extending substantially vertically between the floor and one of the frame and the ring connected to the frame, and positioned radially outside the nozzles on the rotatable ring.

6. An apparatus according to claim 1, characterized by spring means biassing the lips towards the floor.

* * * * *